US005715534A

United States Patent [19]

Mobley

[11] Patent Number: 5,715,534

[45] Date of Patent: Feb. 10, 1998

[54] HATS AND CAPS WITH MOVEABLE BILLS OR BRIMS

[76] Inventor: Gwennette Q. Mobley, 119 Bidwell Ter., Rochester, N.Y. 14613

[21] Appl. No.: 605,913

[22] Filed: Feb. 23, 1996

[51] Int. Cl.[6] ..... A42B 1/06

[52] U.S. Cl. ..... 2/10; 2/175.1; 2/195.1

[58] Field of Search ..... 2/10, 171, 171.1, 2/171.4, 171.7, 171.8, 175.1, 175.2, 195.1, 209.11, 209.12, 209.13

[56] References Cited

U.S. PATENT DOCUMENTS 1,232,992 7/1917 Stering ..... 2/10
2,855,604 10/1958 Austin ..... 2/171.1
5,471,684 12/1995 Casale ..... 2/195.1
5,533,211 7/1996 Mehrens ..... 2/195.1
5,613,246 3/1997 Alexander ..... 2/10

*Primary Examiner*—Diana Biefeld
*Attorney, Agent, or Firm*—Jaeckle Fleischmann & Mugel, LLP

[57] ABSTRACT

A unique fashion or sports hat or cap assemblage having a brim or bill/visor, distinctly designed with the capability to rotate the brim or bill/visor up to 360 degrees without detachment, and including interchangeable and multiple options for the crown, body and visor portions.

10 Claims, 4 Drawing Sheets

HATS AND CAPS WITH MOVEABLE BILLS OR BRIMS

BACKGROUND OF THE INVENTION

The present invention relates generally to hats and caps used as headwear, and more specifically to hats and caps having one or more bills or brims that also may be moved or rotated to various positions around the circumference of the crown of the headwear without detaching the bill or brim from the headwear.

Hats and caps are a part of everyday life for a vast number of people, both young and old. Although until recently hats and caps were used rather sparingly, there has been a significant resurgence in the popularity and use of hats generally and, in particular, hats or caps with brims and bills. Further, caps such as baseball-type caps are being worn in different ways than originally intended, for example, as a means of self-expression by wearing a cap such that the bill faces in other than the normal forward direction.

Others have disclosed the ability to detach a single bill from a baseball-type cap so that the bill may be replaced with a different bill or may be reattached to the headwear at different positions. For example, Brown et al. (U.S. Pat. No. 4,630,317) teaches headwear that has a bill, either by itself or as part of a baseball-type cap, that may be detached from and reattached to a headband via hook and loop attachment means, such as VELCRO® brand attachment means, available from Velcro USA Inc., or by snaps and/or zippers. Linday (U.S. Pat. No. 5,099,524) teaches a segmented baseball-type cap in which the bill may be removed from and reattached to the crown of the cap also by hook and loop attachment means.

Each of Tapia I (U.S. Pat. No. 4,873,726) and Tapia II (U.S. Pat. No. 5,070,545) describes baseball-type caps which feature a detachable bill. In Tapia I, the bill detaches from and reattaches to the body of the cap by the use of hook and loop attachment means, whereas in Tapia II, the bill is detached from and reattached to the body of the cap by the use of either hook and loop attachment means, a zipper system, or a plurality of snaps. Douglas (U.S. Pat. No. 5,437,062) further describes a baseball cap with a removable bill which may be attached in various positions to the crown of the cap in two ways: by a hook and loop attachment means and by a system of cooperating strap elements, but in both cases the bill must be removed from the cap body in order to change the position of the bill.

The present invention achieves the goal of repositioning the bill or brim portion of a cap or hat to a more desired location with less effort and without mussing of hair, because it does not require detachment and reattachment of the bill or brim portion or removal of the cap or hat from the wearer's head. Moreover, the present invention also provides for a unitary headwear that can give the appearance of being two or more hats worn simultaneously.

SUMMARY OF THE INVENTION

According to the present invention, there can now be provided headwear having a detachable bill or even a full brim that can be repositioned relative to the crown of the headwear while wearing the headwear and without detaching the brim or bill from the crown. In addition, my invention can provide for unitary headwear that gives the appearance of being at least two separate hats and in which two or more bills or brims can be repositioned relative to balance of the headwear, such that neither the headwear nor the bills or brims need be removed from the headwear to be repositioned. The ability to easily position one or more bills or fuller brims on a hat also allows the wearer to adjust them to optimize their shading effect and protection from elements of weather such as rain or hail. The present invention facilitates these uses of hats for self-expression, shading, and protection by freeing the wearer from the necessity of removing the hat or of detaching the bill or brim of the hat whenever the wearer wants to change its position. The means of attachment and detachment of the bills and brims to the headwear also facilitates the creation of a unitary hat design that, when in place on the wearer's head, can give the appearance that two or more hats being worn.

A preferred embodiment of the present invention comprises a hat or cap including a crown, at least one T-channel and at least one U-channel, one of which channels is attached to the crown and circumscribes at least a substantial portion of the exterior surface of the crown, a brim or bill which is attached to the other of the channels, the U-channel and the T-channel engaging each other such that the T-channel slides along the interior surface of the U-channel. If preferably one or more removable and/or replaceable bills or brims are desired, the channels can be constructed to permit ready attachment and detachment but are securely in place when attached to the crown.

It is an object of the present invention to provide headwear having an attachment means so that the bills or brims of the headwear are easily detachable and reattachable, enabling the headwear to be worn with any of a number of bills or brims, or with no bill or brim at all.

It is another object of the present invention to provide headwear in which the bills or brims can be repositioned relative to the body of the headwear without detaching the bills or brim from the headwear or removing the headwear from the wearer's head.

It is yet another object of the present invention to hide or mask from view the means by which the brims or bills may be repositioned in order not to detract from the appearance of the headwear.

It is still another object of the present invention to allow the wearer of a hat to reposition the bills or the brims around the hat while allowing a logo or design imprinted on the crown of the hat to remain facing forward or to face in a direction of the wearer's choice that is independent of the wearer's choice of bill or brim position.

It is a further object of the present invention to give the illusion that the wearer may be wearing two separate hats when the headwear is in place on the wearer's head.

BRIEF DESCRIPTION OF THE DRAWINGS

These and other objects and advantages of the invention will become clearer from the following detailed description of the preferred embodiments and the accompanying drawings in which like numbers represent like elements and wherein.

DESCRIPTION OF THE PREFERRED EMBODIMENT

Figure 1:
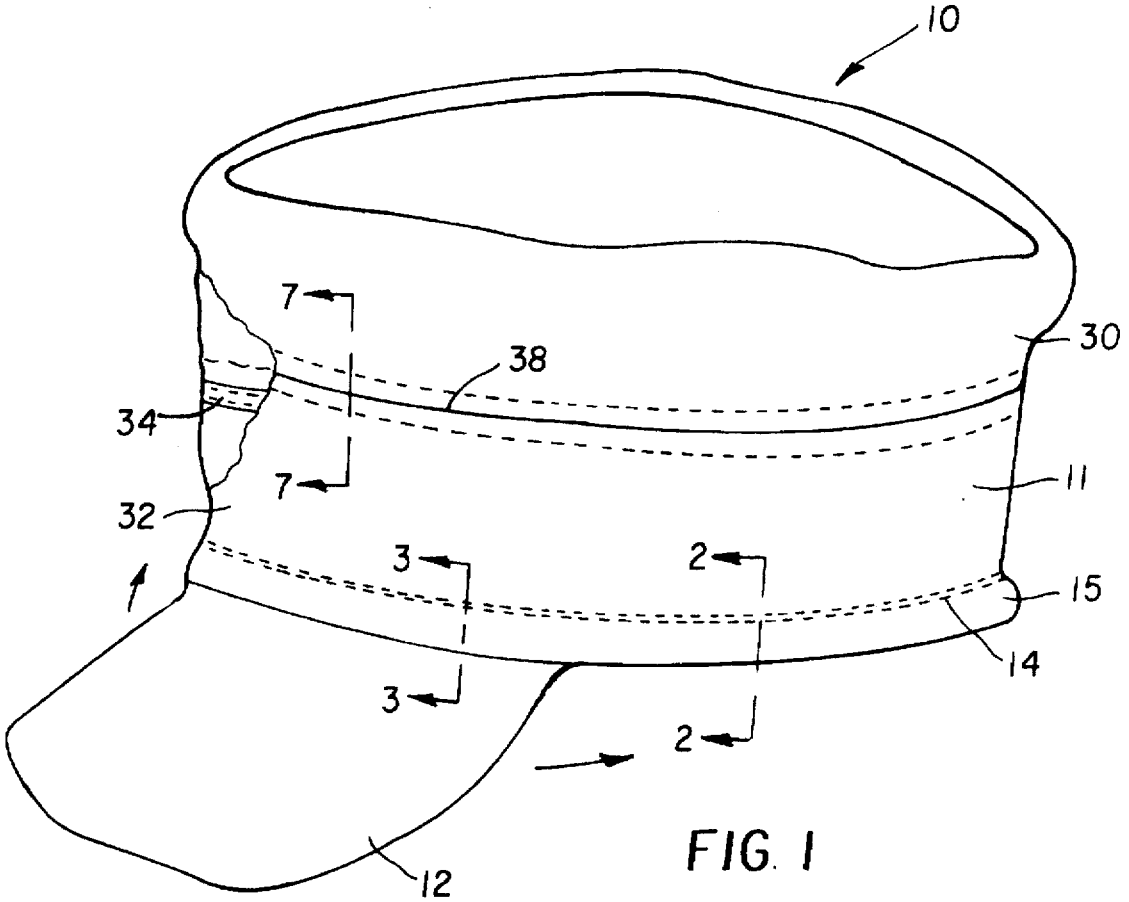
FIG. 1 is a perspective view of a preferred embodiment of the invention.
Figure 2:
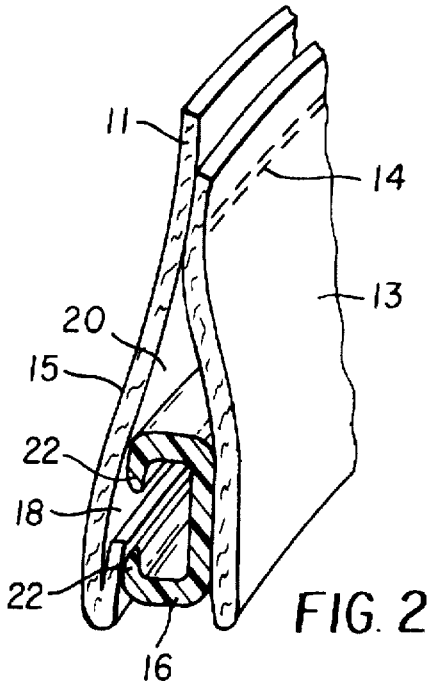
FIGS. 2 and 3 are partial sectional views of the first embodiment of the invention taken along line 2—2 and line 3—3, respectively, in FIG. 1.

With reference to the preferred embodiment of the invention as shown in FIG. 1, hat 10 includes a "square crown" 11 made of fabric and a bill or brim 12, although it should be noted that the invention is not limited to a particular crown or bill shape or material and in fact works with any number of crown and bill shapes, conventional materials and relative rigidity, including very flexible or "floppy" crowns and brims. Referring to FIG. 2, inside the crown 11 is a headband 13 that circumscribes at least a substantial portion and preferably the entire interior circumference of the crown 11. Headband 13 may take the form of any conventional headband material such as leather or fabric or may be a full or partial interior lining for the crown 11. Headband 13 is attached to the crown 11 along its circumference at least at seam line 14 by stitching, permanent adhesive or the like, as is well known in the art, that is spaced from the lower edge of the crown 11 and the headband 13 so that an accessible space is created between the crown 11 and the headband 13 and by which the lower edge of crown 11 forms a loose flap 15 under which is positioned the sliding mechanism according to my invention. The lower edges of both the crown 11 and the headband 13 preferably are hemmed to improve appearance and to eliminate unravelling of the fabrics.

Figure 3:
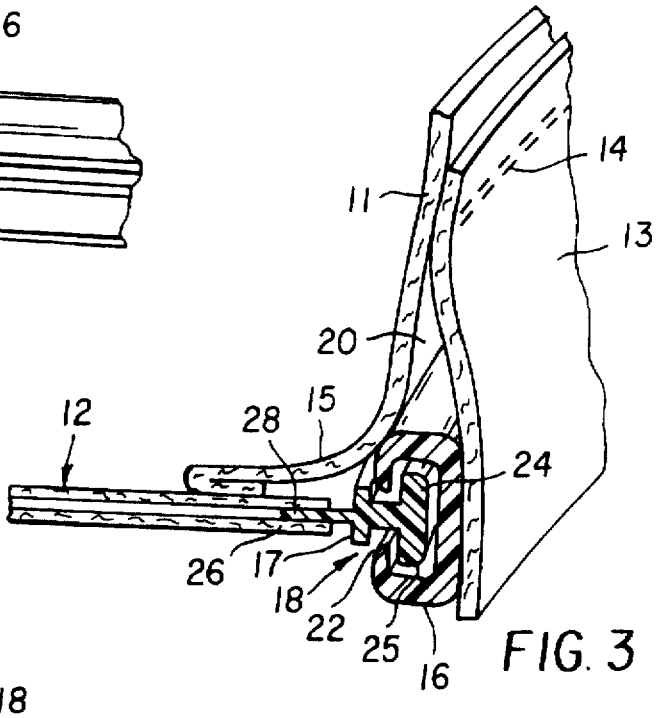
Figure 4:
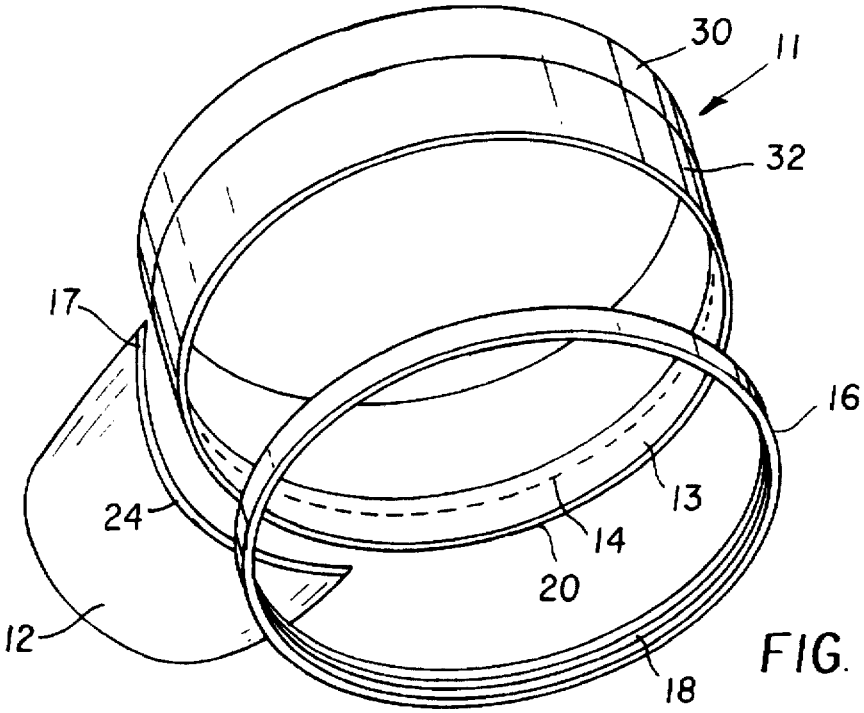
FIG. 4 is an exploded view of the embodiment of FIG. 1.

As shown in FIGS. 2 and 3, the bill 12 is attached to crown 11 by a sliding track mechanism having female and male interlocking parts which are a U-channel 16 and T-channel 17, respectively. Both channels are preferably made of a flexible semi-rigid material such an extruded polyvinyl chloride, or PVC, as will be described. U-channel 16 is adhesively fixed to the headband 13 by any well known adhesive that will permanently bond PVC to a fabric, as shown within the space formed between the flap 15 of crown 11 and the headband 13 such that it circumscribes at least a substantial portion or, preferably as shown by FIG. 4, the entire circumference of the outward-facing surface of the headband 13 and with its open side 18 facing outwardly toward the inward-facing surface 20 of the crown 11. The open side 18 of U-channel 16 includes a pair of inwardly extending spring-like lips 22 of thinner cross section which retain the cross portion 24 of T-channel 17 and enable the T-channel 17 to slide along at least a portion of the length of the U-channel 16. For a firm construction, the inner edge portion 26 of the bill 12 preferably is permanently affixed to and covering the leg portion 28 of T-channel 17 from both sides by an adhesive or stitching, but it may also be attached by hook-and-loop fasteners such as VELCRO® if it is desired to permit separation of the bill 12 from the T-channel 17. However, such removable attachments may as with the prior art not enable a secure and uniformly clean appearance when used.

Figure 5:
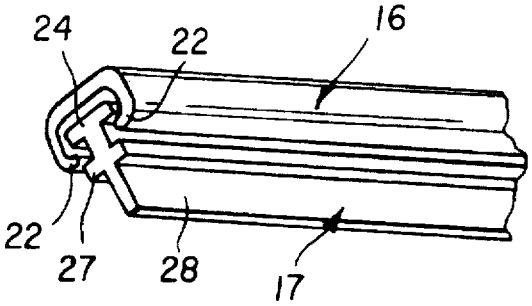
FIGS. 5 and 6 are perspective and end detail views of the sliding mechanism of my invention.
Figure 6:
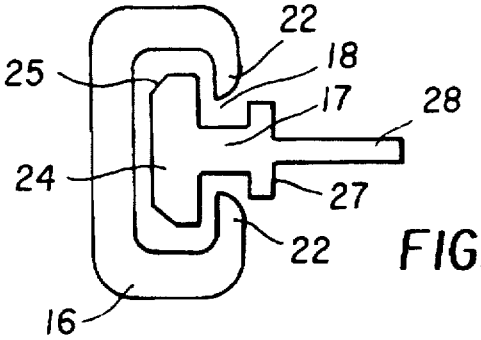

Referring to FIGS. 5 and 6, the spaces and dimensions have been exaggerated for clarity. U-channel 16 and T-channel 17, although both made of a flexible, semirigid PVC so as to be extrudable in longer lengths and bendable into various circular shapes, preferably are of differing densities, with the U-channel 16 of a lower density so that the lips 22 can be resiliently bent inwardly and outwardly as the T-section 24 of the T-channel is inserted and removed, but spring back into retaining position after attachment and detachment of the bill or brim 12. The inner side 25 of T-section 24 is chamfered to facilitate insertion. T-channel 17 preferably includes a collar 27 to ensure smooth gliding against lips 22. As is now evident, when the bill or brim 12 is attached to the crown 11 by insertion of the T-section 24 of the T-channel 17 into the U-channel 16 and slidingly held by the lips 22 of the U-channel 16, the bill or brim 12 may easily be rotated around the circumference of the crown 11 to any desired position and without removing the hat 10 from the wearer. When so attached, the bill 12 may be moved around the circumference of the crown 11 by the sliding of the T-channel 17 within and along the U-channel 16. When the headwear is properly assembled, the lower flap 15 of the crown 11 covers the T-channel 17 and the U-channel 16 so that they do not detract from the appearance of the headwear 10.

Because the track mechanism 16, 17 is sandwiched between the lining or headband 13 and the fabric or crown 11, there is a smooth continuous gliding motion, and the mechanism never touches the head of the wearer.

Figure 7:
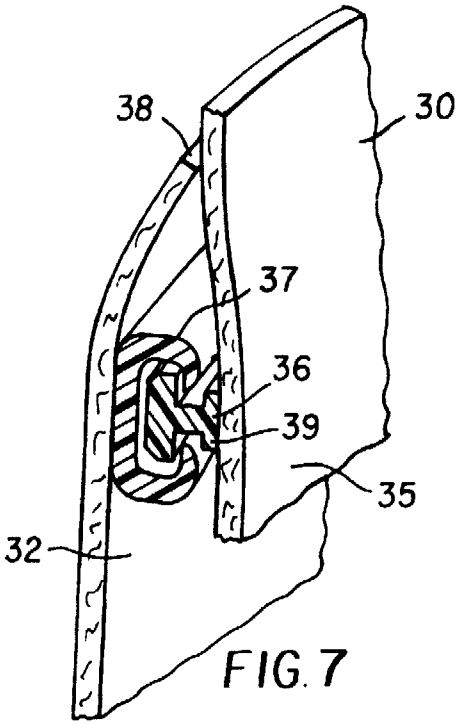
FIG. 7 is a partial sectional view taken along line 7—7 of FIG. 1.

Although in the preferred embodiment T-channel 17 is affixed to bill 12 and U-channel 16 is affixed to crown 11, it also is possible for the T-channel 17 to be affixed to the crown 11 and the U-channel 16 to be affixed to the bill 12. Similarly, if hook and loop attachment means are used, bill 12 can be detached reattached by the disengagement and re-engagement to the T-channel 17 without detaching the T-channel 17 from the U-channel 16. A further advantage of my invention is illustrated as generally shown in FIG. 7 in which the top portion 30 of crown 11 can be removed or rotated relative to the bottom portion 32 of crown 11 by a similar sliding mechanism 34 in which the bottom edge 35 of the top portion 30 is adhesively fixed to another T-channel 36 extending the full circumference and the corresponding U-channel 37 also the full circumference adhesively fixed to the inside surface of the bottom portion 32 sufficiently below the uppermost edge 38 of the bottom portion 32 to enable the upper edge 38 to cover the U-channel 37 when the top portion 30 is removed. In this case, however, the T-channel leg extension corresponding to extension 28 of T-channel 17 has been removed and the fabric of top portion 30 adhesively fixed to collar 39.

Figure 8:
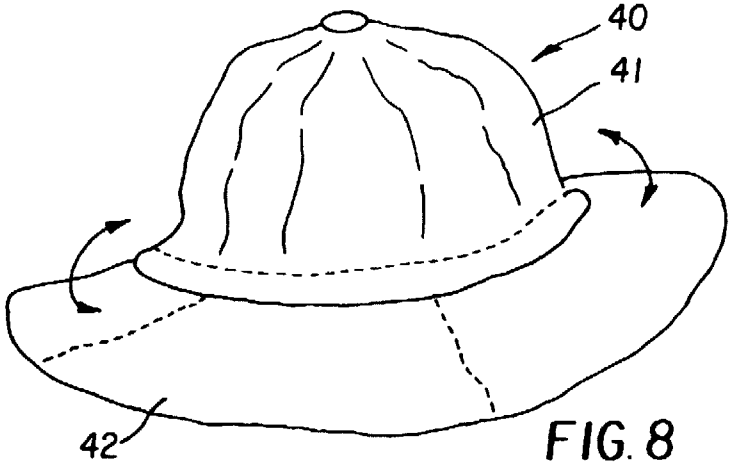
FIG. 8 is a perspective view of a second embodiment of the invention showing a full brim.
Figure 9:
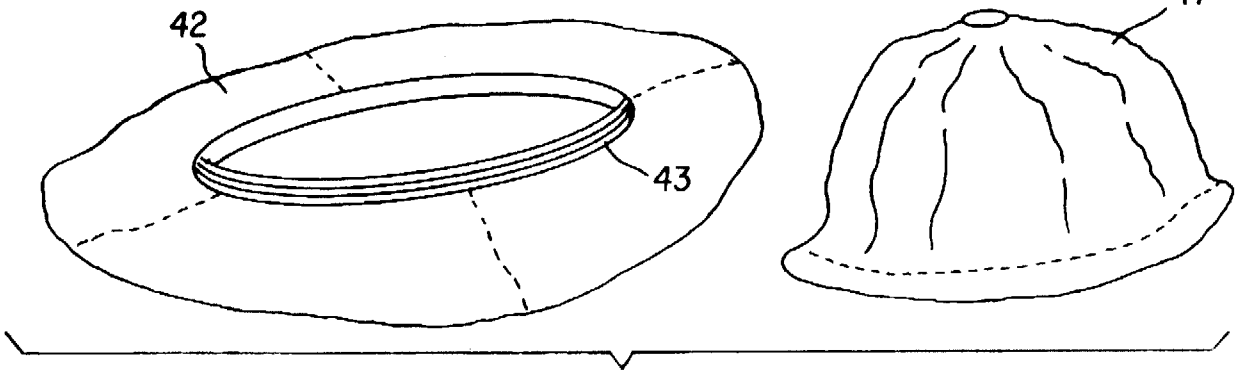
FIG. 9 is a perspective view of the second embodiment with the brim removed.

An alternative preferred embodiment of the invention is shown in FIGS. 8 and 9 to illustrate generally that my invention also works well with a full brimmed hat 40 in which the crown 41 can be worn with or without the brim 42. Brim 42 is attached to a T-channel in the same manner as brim 12 of the first embodiment, except that the T-channel 43 extends the full circumference of the hat along with brim 42. Brim 42 can be differently designed along its periphery so as to present different fashion statements as it is rotated, or different colored sections to indicate a particular position in a game. Alternatively, brim 42 may comprise differing structural components along its periphery, as for example a solid portion to act as an eye shade and a tinted translucent plastic to permit filtered light to pass through, or a full face-length screen mesh over a substantial part of the circumference of the brim 42 to selectively cover the face from insects and the like. Otherwise, the structural portions of this second embodiment are formed in the same manner as in the first embodiment.

Although not shown in the drawings, a headband on the interior of crown 41 may take the form of a conventional headband or may be a full or partial lining for crown 41. As with the first embodiment, the headband is attached to the crown 41 by stitching that is spaced from the lower edge of crown 41 and the headband so that an accessible space is created between crown 41 and the headband to receive the sliding mechanism.

Figure 10:
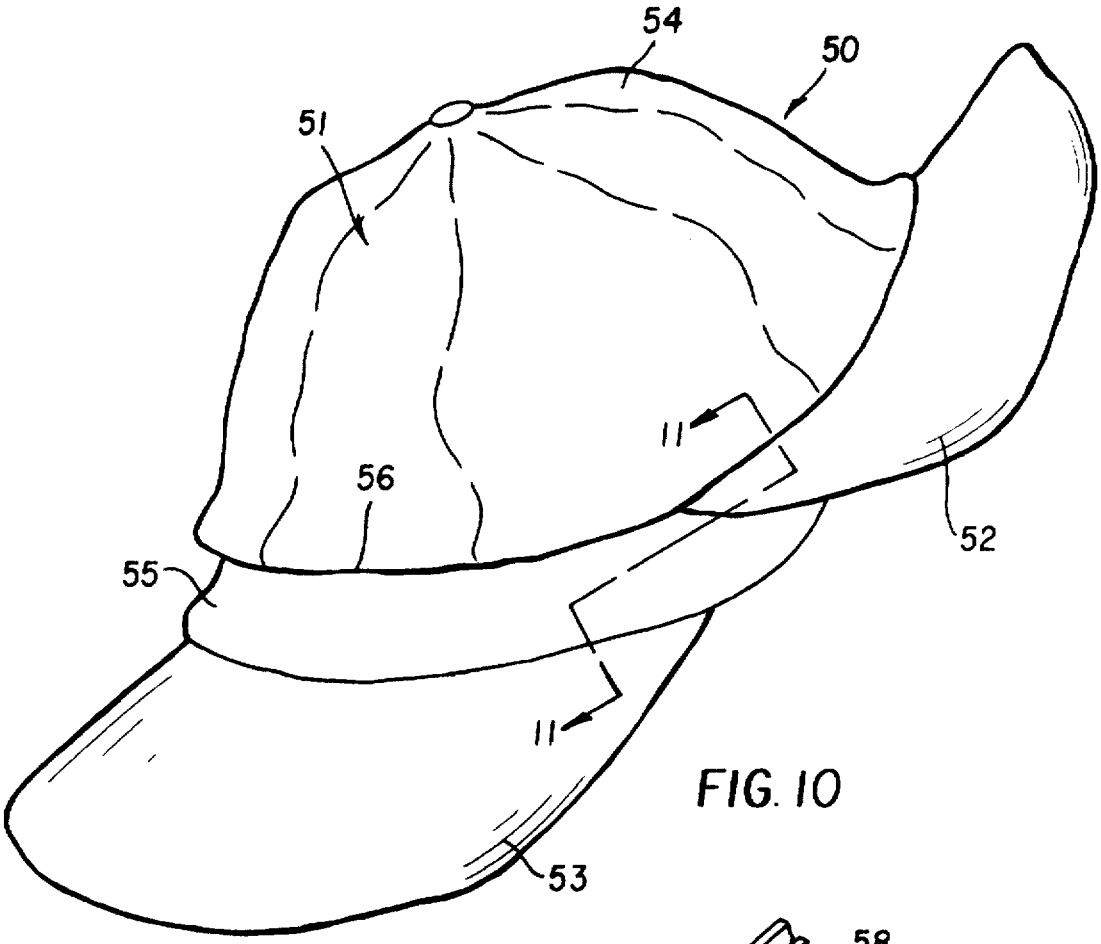
FIG. 10 is a perspective view of a third embodiment of the invention simulating two hats.
Figure 11:
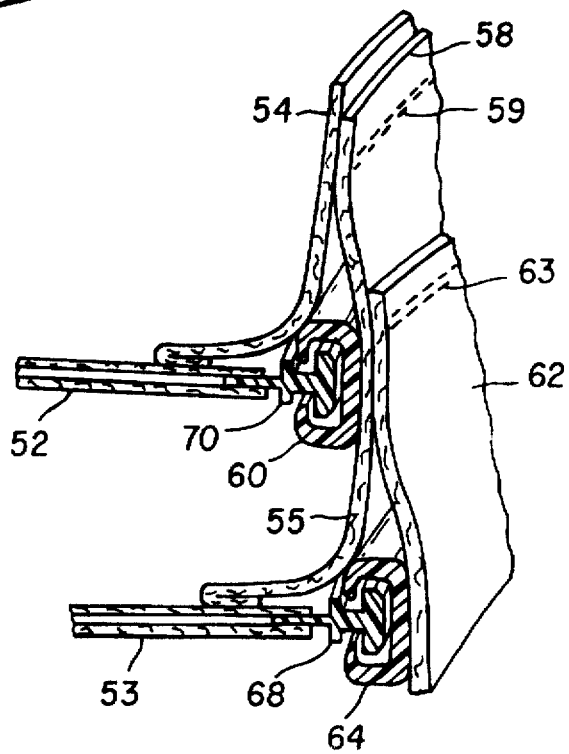
FIG. 11 is a partial sectional view of the third embodiment of the invention taken along line 11—11 in FIG. 10.

A third and further unique preferred embodiment of my invention is shown in FIGS. 10 and 11. As shown in FIG. 10, headwear 50 comprises crown 51 and two bills 52 and 53. Crown 51 comprises upper crown 54 and lower crown 55. Upper crown 54 is formed in the same manner as the complete crown portion of a regular hat having a hemmed lower edge 56. The lower crown 55 approximates a truncated cone, in which the outside diameter of its upper edge 58 is equals the inside diameter of the lower edge 56 to which it is sewn as shown at seam line 59 along their respective circumferences. The crown shapes, however, will be governed by the hat styles. As shown in FIG. 11, a headband or lining 62 is sewn at seam 63 inside the lower crown 55 in the same manner as in the first embodiment and in which the U-channel 64 is adhesively fixed. The upper edge 58 of lower crown 55 in turn is sewn at seam 59 and acts as the liner for the upper crown 54 and to which a second U-channel 66 is adhesively fixed. Each of the U-channels 64 and 66 receive the corresponding removable T-channels 68 and 70 of the two bills 53 and 52, respectively. The two crown portions 54, 55 and their respective bills 52, 53 can be of the same or different designs and can provide a substantial opportunity for creativity. Although in a preferred embodiment the upper crown 52 and the lower crown 53 together form a dome-shaped crown, it is understood that the crown can take any firm or floppy shape. For fashion millinery, headband 62 preferably is a full or partial lining of the crown at least to cover the inside seams connecting the upper and lower crown portions 54, 55. Similarly, the bills 52, 53 can be rotated along and/or removed from crown 51 to present very different appearances of the headwear.

Although our invention is described by reference to specific preferred embodiments, it is clear that variants can be made and other materials used without departing from the spirit of the invention as described and claimed.

I claim:

1. Headwear comprising a crown having a substantially circumferential body to fit on a wearer's head and having an inner surface, at least one bill or brim extending substantially laterally away from the crown body and a wearer's head, and at least one slide means for connection of the bill or brim to the crown body and for rotation of the bill or brim relative to the crown body, the slide means comprising a first channel member attached to the periphery of the crown body and extending a substantial portion around the circumference of the crown body, and a second channel member attached to the bill or brim adjacent the crown body, the first and second members having interlocking means for slidable engagement of the second channel member relative to the first channel member, and further comprising a headband with an outer surface and attached to the inner surface of the crown body along the circumference of the crown body and forming a free flap on the crown body, and wherein the first channel member is attached to the outer surface of the headband between the headband and the flap of the crown body, in which the flap covers the first channel member and the headband prevents the first channel member from touching a wearer's head.

2. Headwear according to claim 1 wherein one of the channel members comprises a substantially U-shaped cross section and the other of the channel members comprises a substantially T-shaped cross section having a T-section fitting into the U-shaped channel member and a leg portion extending outwardly from the U-shaped channel member.

3. Headwear according to claim 2 wherein the bill or brim is fixed to the leg portion of the T-shaped channel member, the U-shaped channel member is fixed to the crown body, and the T-shaped channel member rotates relative to the crown body within the U-shaped channel member.

4. Headwear according to claim 2 wherein the U-shaped channel further comprises an open side with flexible opposing lips overlapping the T-section, the opposing lips being flexible to permit insertion and removal of the T-section from the U-shaped channel for detachment of the bill or brim from the crown body.

5. Headwear according to claim 2 in which the U-shaped channel further comprises an open side with flexible opposing lips and the leg portion of the T-shaped channel comprises a collar riding outside of and alongside the opposing lips of the open side of the U-shaped channel.

6. Headwear according to claim 1 and further comprising at least one additional bill or brim and one additional slide means, the one additional bill or brim spaced from the one bill or brim and the one additional slide means for connecting the one additional bill or brim to the crown and for rotation of the one additional bill or brim relative to the crown and to the one bill or brim.

7. Headwear according to claim 1 wherein the crown body is comprised of at least a lower portion and an upper portion, each portion comprising at least a substantial part of the overall height of the crown body, and further comprising at least one additional slide means for connecting the upper and lower portions and for rotation of the upper portion relative to the lower portion.

8. Headwear according to claim 7 wherein each of the slide means comprises a first channel member attached to the lower crown portion and extending substantially around the entire circumference of the lower crown portion, and a second channel member, one of which second channel members is attached to the bill or brim and the other of said second channel members is attached to the upper crown portion, the first and second members of each of the slide means having selectively detachable interlocking means for slidable engagement of the second channel member relative to the first channel member, and for removal of the second channel member from attachment to the first channel member.

9. Headwear comprising a first part fitting on a wearer's head, a second part moveable relative to the first part, and a sliding track mechanism having first and second interconnecting sections in which one of the sections is moveable along the length of the other section, the first said section attached to the first part and the second section attached to the second part, wherein one of said sections comprises a substantially U-shaped channel with an open side and attached to one of said parts, and the other of said sections comprises a substantially T-shaped channel having (a) a cross member fitting inside the U-shaped member and (b) a leg member extending outwardly from the open side of the U-shaped member and to which the other of the parts is attached, the U-shaped channel and the T-shaped channel each comprising a flexible, semirigid material of extrudable plastic bendable into various shapes, and in which the densities of the plastic for the channels are different, with one of the channels being sufficiently resilient to enable detachment and reattachment of one of the channels from the other of the channels, wherein the U-shaped channel includes bendable and resilient opposing lips at its open side, and the T-member is chamfered to bend the lips during attachment of the T-shaped channel.

10. Headwear according to claim 9 and in which the leg member of the T-shaped channel further comprises a collar riding against the lips for smooth rotation of the T-shaped channel.

* * * * *